United States Patent [19]

Holz et al.

[11] 4,031,429

[45] June 21, 1977

[54] INFORMATION DISPLAY AND METHOD OF OPERATING WITH STORAGE

[75] Inventors: George E. Holz, North Plainfield; James A. Ogle, Neshanic Station, both of N.J.

[73] Assignee: Burroughs Corporation, Detroit, Mich.

[22] Filed: May 12, 1976

[21] Appl. No.: 685,550

Related U.S. Application Data

[63] Continuation of Ser. No. 83,200, Oct. 22, 1970, abandoned, which is a continuation of Ser. No. 780,099, Nov. 29, 1968, abandoned.

[52] U.S. Cl. ..... 315/169 TV; 313/188; 313/217

[51] Int. Cl.[2] ..... H05B 41/16

[58] Field of Search ..... 315/169 TV, 169 R; 313/188, 217; 340/324 M

[56] References Cited

UNITED STATES PATENTS

| | | | |
|---|---|---|---|
| 2,858,480 | 10/1958 | Shadowitz | 315/169 TV |
| 3,042,823 | 7/1962 | Willard | 315/169 TV |
| 3,206,638 | 9/1965 | Moore | 315/169 R X |
| 3,262,010 | 7/1966 | Kazan | 315/169 TV |
| 3,497,751 | 2/1970 | Cullis | 315/169 TV |
| 3,509,408 | 4/1970 | Holz | 315/169 TV |
| 3,509,421 | 4/1970 | Holz | 315/169 TV |
| 3,609,746 | 9/1971 | Trogdon | 315/169 R X |

*Primary Examiner*—Eugene R. LaRoche
*Attorney, Agent, or Firm*—Kevin R. Peterson; Robert A. Green

[57] ABSTRACT

A method and circuit for operating a gaseous discharge device which, in one form, comprises a plurality of discrete gas cells, each having its own cathode and anode electrodes arrayed in a matrix such that the cells can be activated and sustained in different groupings to represent different characters. The gas cells may be small-area light sources arrayed in rows and columns, with each row of cells having a common cathode electrode, and each column of cells having a common anode electrode. Each cell can be turned on, and caused to strike a glow discharge, by having the required firing potential applied between its anode and cathode electrodes. Cells which have been thus turned on can be kept on, so as to impart a storage or memory characteristic to the matrix, by means of sustaining pulses applied directly to their anodes and cathodes, with no intervening current-limiting impedances being required. The desired operation, that is, the sustaining of glow discharge at a controlled level of current flow and light output, is achieved by properly tailoring the parameters of the sustaining pulses, that is, their amplitude, time duration, and repetition rate.

44 Claims, 13 Drawing Figures

INVENTORS
GEORGE E. HOLZ
JAMES A. OGLE
BY Robert A. Green
ATTORNEY

INVENTORS
GEORGE E. HOLZ
JAMES A. OGLE
BY Robert G. Green
ATTORNEY

INVENTORS
GEORGE E. HOLZ
JAMES A. OGLE
BY Robert G. Green
ATTORNEY

INVENTORS
GEORGE E. HOLZ
JAMES A. OGLE
BY
Robert G. Green
ATTORNEY

INVENTORS
GEORGE E. HOLZ
JAMES A. OGLE
BY Robert C. Green
ATTORNEY

INFORMATION DISPLAY AND METHOD OF OPERATING WITH STORAGE

CROSS-REFERENCE TO RELATED APPLICATIONS

This application is a Continuation of Application Ser. No. 83,200, filed Oct. 22, 1970, now abandoned, as a continuation of Ser. No. 780,099, filed Nov. 29, 1968, now abandoned.

BACKGROUND OF THE INVENTION

Gas-filled display devices have been known and used for a considerable length of time. One known type of device comprises a small gas-filled glass envelope having anode and cathode electrodes sealed in the envelope. Another type of device is known as a display panel and comprises a flat structure which has a large number of gas-filled cells arrayed in rows and columns and having a row or X conductor for each row of cells and a column or Y conductor for each column of cells, with one cell being located at each intersection of a row and column electrode. These prior art devices are caused to turn on, and strike a glow discharge, by means of applied D.C. or A.C. voltages, but, when the applied voltages are removed, the devices generally turn off and do not glow.

There are some relatively complex display devices having auxiliary electrodes in which the ON state and glow discharge can be sustained by the application of a potential other than the initial firing potential. Usually, in the operation of these devices, a bias voltage is applied which is below the firing voltage but above the extinction voltage, and then a triggering or signal voltage is added so that the total applied voltage is equal to, or exceeds, the firing voltage, and the device is turned on. Thereafter, when the triggering pulse terminates, the cell is maintained ON by the bias voltage.

There are also relatively complex circuits which have been devised to sustain glow discharge by storing or continually regenerating the applied signal information. In these circuits, it has been considered necessary to provide a current-limiting element or impedance, such as a resistor or capacitor, in series with each individual display device or cell to control and limit the current therethrough to a safe level while glow discharge was sustained. It has also always been necessary to provide a resistor in series with each cell of a multi-cell panel to obtain uniformity in light output and to limit current flow in the individual cells.

It can be seen that panel display devices which include tiny light-producing cells might have tens or hundreds of thousands of such cells, and individual resistors for these cells would represent a considerable parts cost. In addition, the operation of assembling the resistors with a panel would represent a considerable labor cost and an added complex manufacturing operation.

In addition to the need in the prior art for uniformity in the cells of a panel, it is also necessary that the circuits for operating multi-cell panels themselves be stable and uniform in the circuit components which generate the voltages which drive the cells.

Another type of multi-cell gaseous display panel is currently being developed at the University of Illinois. In this panel, the row and column conductors are separated from the gas cells by thin sheets of glass, so that the conductors are only capacitively coupled to the cells. An A.C. signal applied to all of the conductors imparts a memory characteristic to the matrix, by virtue of stored charges on the glass walls of the cells, and triggering to an ON condition is achieved by trigger pulses applied to selected cells at a precise time during the A.C. sustaining signal.

This matrix disadvantageously requires a sustaining A.C. signal in the order of 1200 volts peak-to-peak, a triggering voltage across a cell of about 400 volts precisely synchronized with the A.C. signal to occur at a particular phase thereof. This method of operation requires considerable uniformity in panel cells, and the required uniformity is difficult to achieve.

SUMMARY OF THE INVENTION

Briefly, the invention comprises the provision of a method and circuit for operating a gas display device to sustain glow discharge therein once it has been produced, by applying pulses of proper amplitude, time duration, and repetition rate directly to the device without intervening current-limiting impedances and without intervening glass plates. The invention also utilizes novel particle sweepout techniques and other control features in conjunction with the novel sustaining concept.

DESCRIPTION OF THE PREFERRED EMBODIMENTS

The principles of the invention relate to the operation of gas-filled glow discharge display devices. The invention is particularly useful with devices of the type shown by G. A. Kupsky in an application entitled COLD CATHODE DISPLAY PANEL, filed on Oct. 2, 1968.

Figure 1:
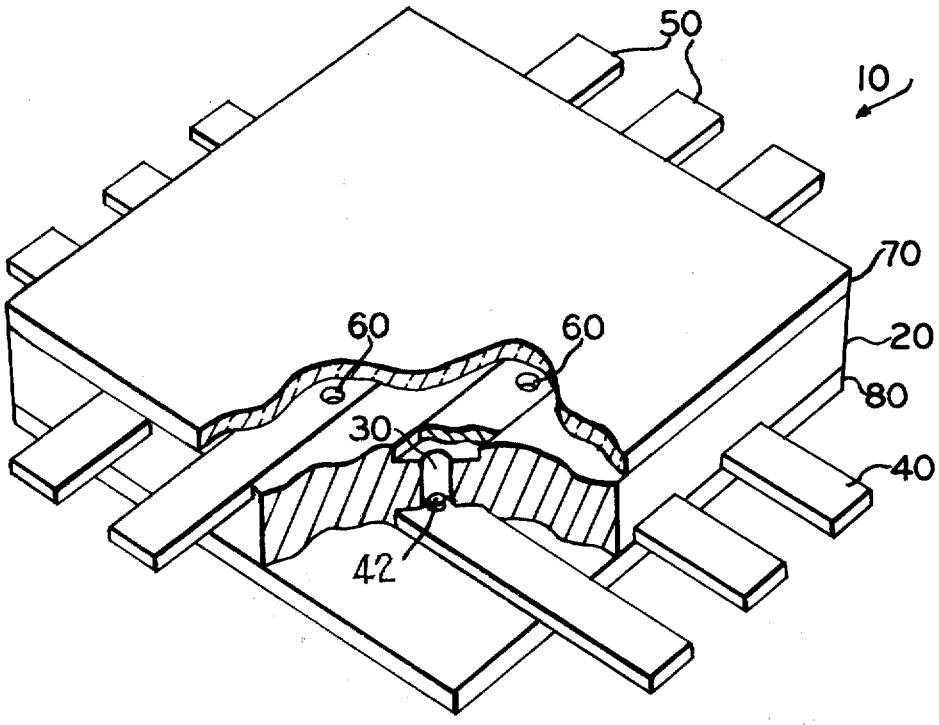
FIG. 1 is a perspective view of one type of display device used in practicing the invention.

A typical display device 10 (FIG. 1) includes a plurality of discrete gas cells, each having an anode electrode and a cathode electrode. In one suitable arrangement, the cells are arrayed in rows and columns and are energizable, either singly or in groups and sequentially, to represent letters, numerals, messages, and the like. The gas cells may be located in individual envelopes separate from each other, or they may be part of a unitary panel, as shown, which includes a central plate 20 having apertures or cells 30 arrayed in rows and columns with parallel cathode electrode strips 40 positioned on the lower surface of the central plate. Each cathode electrode strip is aligned with a line or row of cells 30 and includes a cathode button 42 in each cell 30. The panel 10 also includes parallel apertured anode electrode strips 50 positioned on the upper surface of the central plate and each aligned with a line or column of cells. The apertures 60 in the anode electrode strips permit the glowing gas in the cells to be viewed, but apertured cathodes or transparent anode or cathode conductors could also be used. Various other mechanical arrangements might be employed in anode constructions to permit cells to be viewed.

The cathode electrodes are oriented at right angles to the anode electrodes, and one cell 30 is located at each intersection of an anode and a cathode. Top and bottom glass plates 70 and 80 complete the panel 10. The panel is shown as having three columns and three rows of cells 30, although substantially any number of cells could be provided.

In panels 10 with which the invention has been practiced, cells 30 had a diameter of 0.04 inch and a depth of 1 to 3 mm, and a density of sixteen cells per linear inch. The X and Y electrodes were of stainless steel and were 0.042 inch wide and 5 mils thick. The gas content was as described below.

In the description of the circuit operation below, the display panel 10 is shown schematically, and the row electrodes are called X lines, and the column electrodes are called Y lines.

This generalized representation is intended to indicate that, in any one of the various signal routines to be described below, the different types of pulses or signals can be applied in any desired polarity. This means that a first type of pulse can be applied between an X line as anode and Y line as cathode, or vice-versa, and a second type of pulse can be applied in the same polarity as the first or in the opposite polarity. The orientation of the pulses might be determined in any case by the types of electrode material used, the inclusion of photoemissive materials in the cells, the inclusion of phosphor materials in the cells, etc.

In the panel 10, the cells 30 are filled with an ionizable gas atmosphere including about 99.5% neon and about 0.5% argon, to which is added a small quantity of mercury and a trace of krypton 85. A suitable gas pressure is about 40 Torr at room temperature. Other gas mixtures and pressures can be selected by those skilled in the art to perform the required functions as described below.

The gas cells 30 have a characteristic breakdown or firing voltage Vf which, when applied to a cell for a suitable time period, causes breakdown and an ensuing glow discharge. The breakdown or firing voltage is determined generally by the physical dimensions of a cell, gas pressure, type of gas, electrode materials, etc., as is well known in the art. A cell is turned on and emits light when it has been driven to breakdown and glow discharge.

In practicing the invention, when it is desired to enter information into a cell and thus to turn a cell on and cause it to emit light, a suitable voltage, which may be equal to or greater than the firing voltage Vf, is applied between its X line and its Y line. This voltage Vf is the characteristic D.C. firing voltage of the cell, and it may be applied: (1) by holding one line at a fixed voltage and applying the entire voltage to the other line, or (2) by applying a portion of the voltage to one line and a portion of opposite polarity to the other line. In the latter method, if the voltage portions are equal, and each is one-half of the total voltage, the method is known as half-select operation. Unless otherwise indicated, half-select operation is normally intended in the description below for firing cells and for other operations to be described.

Figure 2:
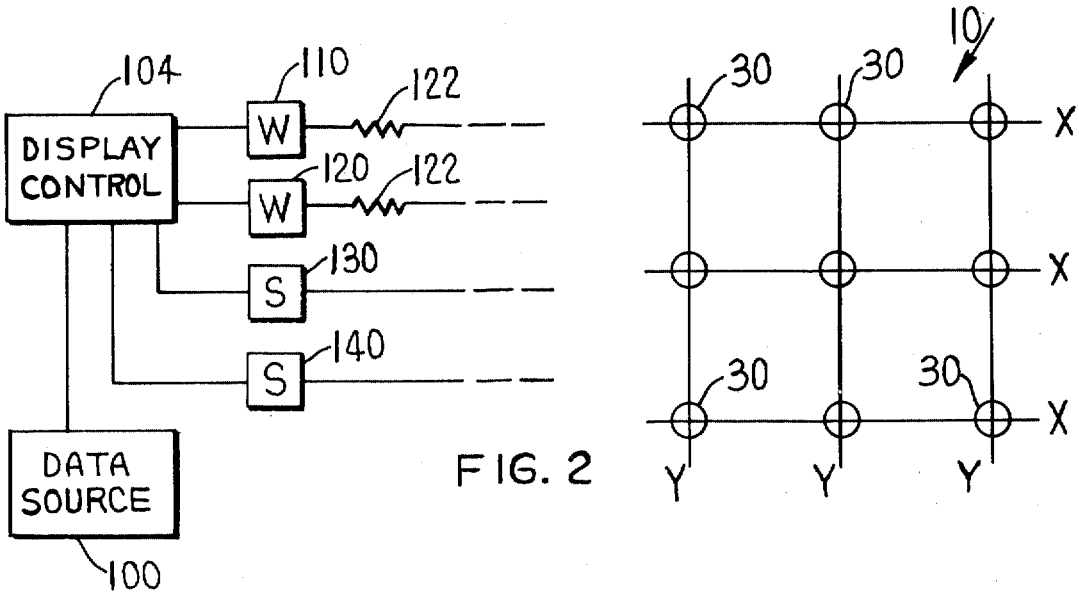
FIG. 2 is schematic reresentation of the device of FIG. 1 and a circuit embodying the invention.

The panel 10 may be coupled to a system (FIG. 2) which includes a data source 100, such as a computer, which processes information through a series of circuit modules to a final display control module 104, from which information is ultimately introduced into one or more cells. For purposes of illustration of the invention, control module 104 feeding into the panel, provides a write signal made up of two signals W of equal and opposite polarity from sources 110 and 120. The write pulses are used to turn cells on and thus to enter information therein. According to the invention, the control module 104 also provides a sustaining signal, made up of two sustaining voltage pulses S of equal and opposite polarity from sources 130 and 140. The sustaining pulses are used to sustain the ON state of a cell, without turning OFF cells ON. The sustaining pulses and their operation are described in detail below. The sources 110 and 120 of write signals are coupled through current-limiting resistors 122 to selected X and Y electrodes of display device 10; however, the sources of sustaining signals are coupled directly, that is, without current-limiting impedances, to all of these electrodes. Diodes are normally provided, although they are not always illustrated, in all lines to separate write pulses from sustaining pulses and to prevent pulse crosstalk between lines.

Resistors are used in the write lines because the turn-on time of cells 30 during the application of write pulses may vary over a relatively wide range so that a cell which turns on early in the pulse period, might develop damaging currents if the current-limiting resistors were not provided. However, these resistors are only needed in one set of lines, either the X lines or the Y lines, and, under some circumstances, for example where cells are quite uniform in characteristics, it may be possible to omit the resistors in the write circuit altogether and simply limit the duration of the write pulses to preclude a harmful current build-up in the cells.

WRITE AND SUSTAIN OPERATIONS

Figure 3:
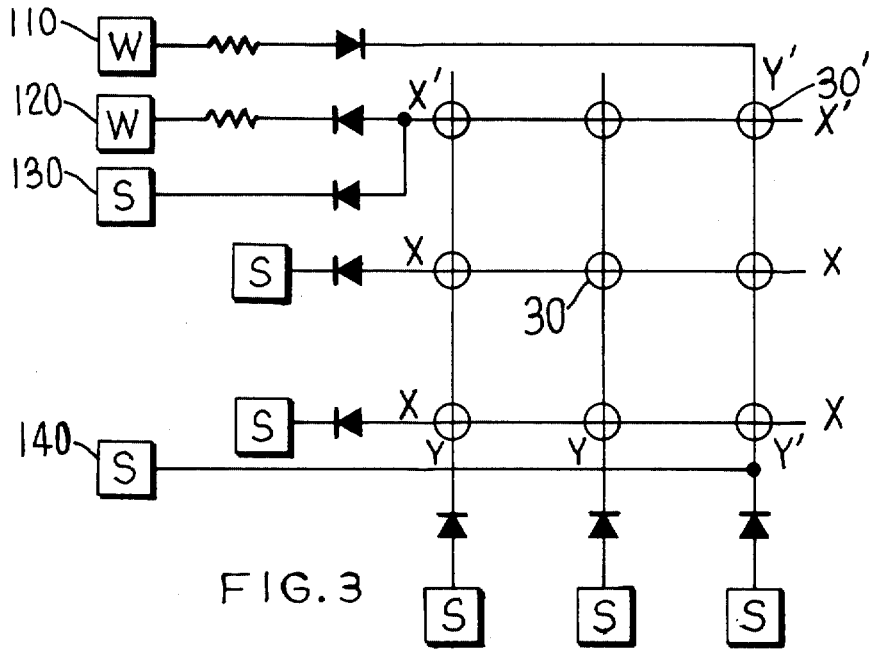
FIG. 3 is a schematic representation of a panel display device and a portion of the circuit of FIG. 2 illustrating a method of practicing the invention.
Figure 4:
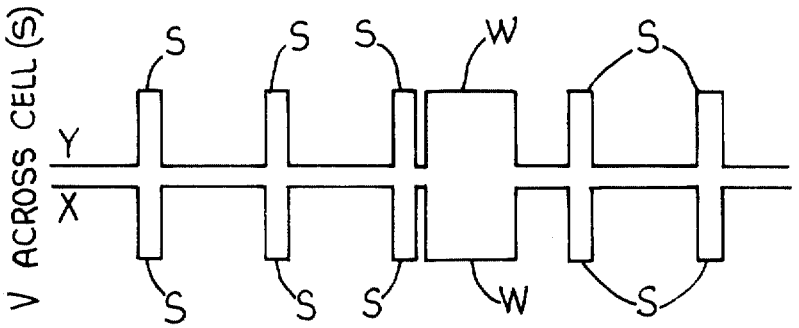
FIG. 4 is a qualitative representation of electrical pulses applied in the method of FIG. 3.

In the following description of the invention, it will be assumed that, initially, the panel 10 contains no information and none of the cells 30 is ON and in glow discharge state. One method of writing information into a cell and sustaining the information in the cell is illustrated in FIGS. 3 and 4 and comprises applying sustaining pulses 3 from the sources 130 and 140 directly, either to selected X and Y lines associated with cells to be turned on or to all X and Y lines at the same time. The peak-to-peak amplitude of the sustaining pulses appearing across each cell is greater than the characteristic D.C. firing voltage Vf of the cells and may conveniently be almost twice as large as Vf; however, the time duration of the sustaining pulses and the repetition rate is such that no significant ionization is produced in OFF cells, and these cells cannot turn ON. In operating the panel 10 described above, sustaining pulses have had a peak-to-peak amplitude of 300 volts, a time duration of 1 to 1½ microseconds, and a spacing between pulses of 50 microseconds.

When it is desired to turn on a cell, such as cell 30', and thus enter information in the panel, write pulses W are applied to the X' and Y' lines. The write pulses are applied during the time period between sustaining pulses S and, preferably, immediately after an applied sustaining voltage has terminated. The X and Y write pulses together have a peak-to-peak amplitude which is larger, for example, something more than 1 to about 2 times larger, than Vf. After the write pulses have terminated, the sustaining pulses continue and sustain cell 30' ON.

Figure 5:
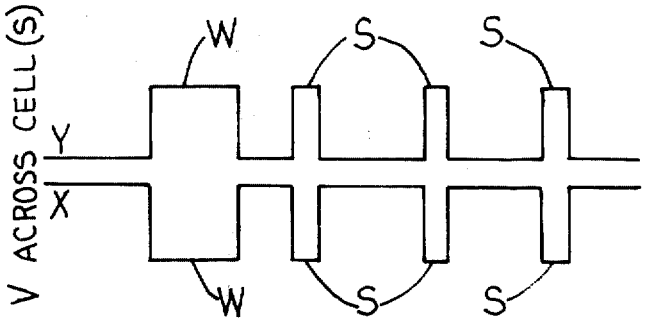
FIG. 5 is a qualitative representation of electrical pulses applied by another method of practicing the invention.

In a modification of the method of the invention described above, as illustrated in FIG. 5, and using the circuit of FIG. 3, information is written into panel 10 by first applying write pulses from sources 110 and 120 to selected X' and Y' lines, before any sustaining pulses have been applied, and then applying the sustaining pulses S to sustain the ON state.

Figure 6:
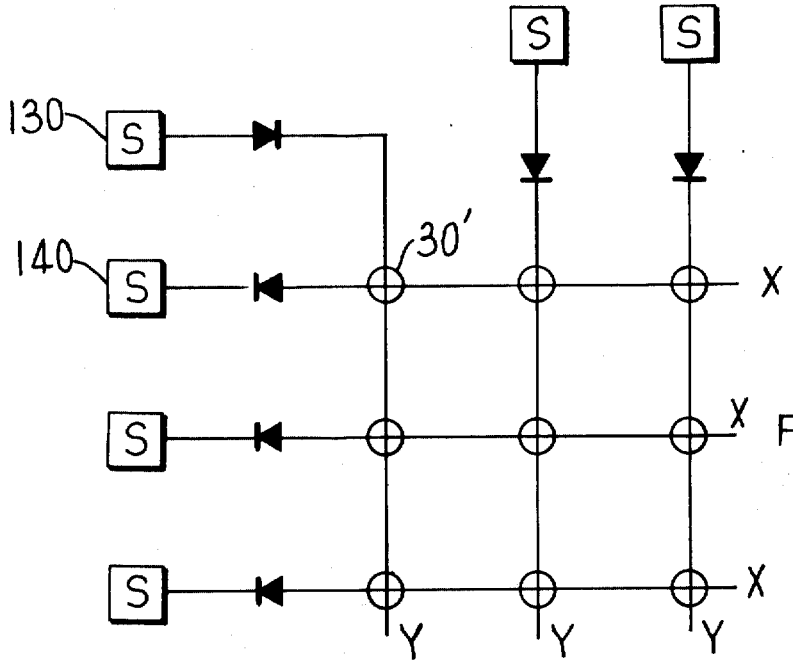
FIG. 6 is a schematic representation of a panel display device and a circuit in which it may be operated.
Figure 7:
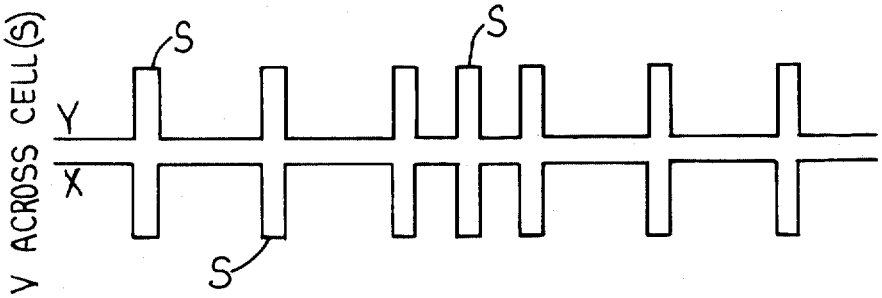
FIG. 7 is a qualitative representation of electrical pulses applied with the circuit of FIG. 6 illustrating another method of operation.
Figure 8:
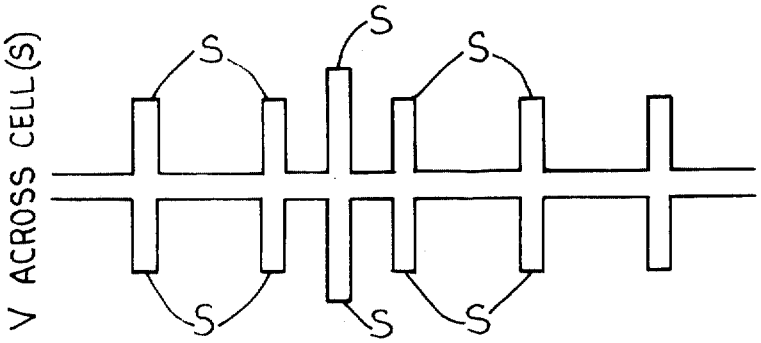
FIG. 8 is a qualitative representation of electrical pulses applied to a display device in accordance with still another method of practicing the invention.

The write operation and sustaining operation may also be carried out as illustrated in FIGS. 6 and 7 by applying sustaining pulses S from sources 130 and 140 to selected X' and Y' lines or to all X and Y lines, and then increasing the repetition rate (FIG. 7) or the amplitude (FIG. 8) or duration of the sustaining pulses on selected X and Y lines for a sufficient time period to permit the selected cells, such as cell 30' to turn on. The sustaining pulses S on the selected lines are then restored to their normal amplitude or duration or repetition rate to sustain the ON state of the cell.

It is to be noted that the write pulses or altered sustaining pulses employed to write in FIGS. 6 and 7 also appear on all cells associated with the selected X line and all cells associated with the selected Y line other than the selected cell; however, these other cells receive only half pulses or only one-half of the effect of the altered pulses and, accordingly, they do not turn on. Only the selected cell or cells at the juncture or junctures of the selected X and Y lines receive the full effect of the write pulses or modified sustain pulses and turn on.

THEORY OF THE INVENTION

The theory of breakdown and generation of glow discharge in gases has been described extensively in the literature. According to the theory, the generation of glow discharge in a gas-filled cell requires initially the presence of one or more initiating electrons, and these electrons may be obtained in different ways, for example, by photoemission from an electrode or from an electron-emitting substance such as barium, or from random cosmic radiation, or the like. Assuming that the required electron(s) are present, when a sufficiently large electric field, for example, that due to the above-described firing voltage or write signal, is applied to the electrodes of the gas cell, this field provides the energy for the complex process which produces breakdown and glow discharge. Under the influence of the electric field, various energy transitions occur; electrons collide with gas atoms, some of which are ionized to form electrons and gas ions, while others are raised to various excited states. In some gases, such as helium, neon, argon, and mercury, electrons of gas atoms can be raised to energy levels known as metastable levels or metastable excited states, and the atom itself is referred to as being in a metastable state. Transitions from a metastable state to a lower energy level do not occur spontaneously but can occur, for example, by means of collisions with electrons or photons or with the wall of the enclosure. However, these collisions occur relatively rarely so that the life of a metastable state is relatively long. Under ideal conditions, the life may be as long as $10^{-3}$ sec., whereas the life of a normal excited state is of the order of $10^{-8}$ sec.

When atoms of several gases are present, the excess energy of the metastable atom of one gas may be given up in exciting or ionizing another. This is known as the Penning Effect.

In the discharge process in a gas mixture including neon, argon, and mercury, metastable atoms of neon may ionize argon atoms, metastable argon atoms may ionize mercury atoms, and all metastable atoms may collide with solids and cause secondary emission of electrons. The ionization process, including the liberation of electrons from the cathode and ionization of the gas atoms and the various actions and interactions with metastable atoms, is cumulative, and at some point in time, the energy changes are such that significant current flows, breakdown occurs, and glow discharge results. Other physical phenomena, such as photo-electric effects, may also take part in the breakdown process. Of course, the applied write or firing voltage must have sufficient amplitude and time duration to achieve the desired breakdown and glow discharge.

It is to be noted that the presence of a gas or gases which can have metastable states is desirable in the present invention, since they are a source of electrons and ions; however, this is not an absolute requirement.

In operation of a panel according to the invention, after a cell has been turned on and the write pulses have been terminated, sustaining pulses are applied to sustain the ON state of a cell. Each sustaining pulse re-fires the cell and produces a burst of light at such a repetition rate that the glow discharge and light output appear to be continuous.

Referring again to the cell content after the write signal has been terminated, it is known that electrons leave the gas volume very quickly, and ions and metastable particles diffuse to the walls of the cells more slowly. The sustaining pulses are applied at a time when there are still sufficient electrons and ions present, or being generated by metastable state atoms, to sustain glow discharge, even though the sustaining pulses are of considerably shorter time duration than the write pulses.

Proper operation of the cells 30 by means of the sustaining pulses requires that sufficient current be generated or a suitable current level be reached to cause glow discharge at a favorable level of light output and power dissipation. In addition, the current level should be such that, if there is cathode sputtering, that this be minimal. Conversely, the current must be kept below the level at which arcing or excessive power dissipation might occur. The current must also be kept low enough, depending on the closeness of cells to each other and their coupling aptitude, so that the ionization in one cell will not fire neighboring cells, or cause neighboring cells to be so unstable as to respond to half-select write pulses, ambient light, etc.

The key to the efficacy of the present invention, that is the key to the sustaining of glow discharge by means of the sustaining pulses, resides in the "character" of these pulses. By character is meant the total quality of the parameters of the sustaining pulses, the parameters being the amplitude, duration, and repetition rate. These parameters are tailored to achieve the desired operation and to satisfy the required conditions set forth above. The required character of the sustaining pulses is affected by many factors such as cell size and volume, type of gas, gas pressure, etc.; however, the required sustaining pulses and their use for any particular display panel or circuit can be readily determined by those skilled in the art with minimal experimentation.

To achieve proper operation of glow discharge devices and to satisfy the foregoing requirements imposed on the sustaining pulses, the prior art has always considered it necessary to use relatively complex and expensive circuit arrangements including current-limiting resistors or other impedance elements in the leads to either the anode or cathode electrodes in each cell. According to the present invention, the desired operation is achieved by the sustaining pulses alone and without current-limiting resistors or other relatively complex circuit arrangements.

As described above, the sustaining pulses can be applied to a panel before a write signal is applied, in which case, cells are unaffected, or they may be applied after a writte signal has been applied and a cell has been turned on, in which case, the cell(s) which is ON is sustained ON, and cells which are OFF are not affected.

The method of the invention permits relatively wide variations in the parameters or character of the sustaining pulses, for which the desired sustaining operation can be achieved. However, outside the range of these permissible variations, ON cells might turn off spontaneously, or OFF cells might turn on spontaneously. The method of the invention also tolerates variations in the electrical characteristics, particularly firing voltage, from cell to cell in the display panel. Since the write and sustain operating signals or pulses are so much larger in amplitude than Vf, even if Vf varies from cell to cell, the operation takes place at a level which is beyond that at which it could be affected by these variations in Vf. Variations which might occur in the circuit parameters are generally of no significance for the same reason.

SWEEPOUT

An auxiliary mechanism known as sweepout may also be used in the present invention. The theory of sweepout is as follows. As described above, ions and electrons are continually being generated by the action of metastable atoms during the time between successive sustaining pulses. Also, they are generated by the sustaining pulses themselves while these pulses are present. In addition, it is possible for spurious ionization to occur due to photoelectric effects, field emission, coupling betwen cells, etc., so that, under some circumstances, OFF cells can turn on spuriously. In order to minimize this sensitivity of OFF cells to spurious ionization effects, the invention utilizes an electric field known as a sweepout field to remove ions from cells at a rate greater than the normal diffusion rate. The sweepout field does not affect uncharged particles, such as the metastable atoms, but it does attract the charged particles to one of the cell electrodes, depending upon the polarity applied, and thus removes them.

The use of a sweepout field to remove ions renders the operation of sustaining glow discharge by the sustaining pulses dependent primarily on the generation of new ions and electrons, especially those generated by the metastable atoms by the Penning Effect or by the electron emission-inducing action of the metastable atoms at the surfaces of the electrodes. When a sweepout field is employed in operating a panel, a D.C. sweepout voltage may be used, but sweepout pulses are preferred, and such pulses are paired as partners with the sustaining pulses in the operating signal routine. When used in a normal sustaining operation, sweepout pulses are of relatively low amplitude, well below the firing voltage. Typical pulses are 10 volts in amplitude and 5 usec. in duration.

Figure 9:
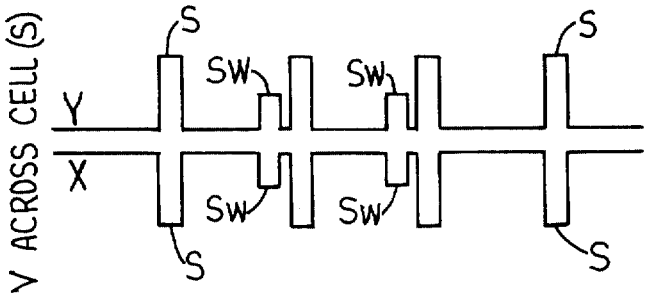
FIG. 9 is a qualitative representation of the use of sweepout pulses in combination with sustaining pulses in practicing the invention.

The effectiveness of sweepout pulses can be controlled by adjusting their amplitude, time duration, and timing with respect to the other signals used in operating a cell. To maximize their effectiveness, they should be applied immediately before the sustaining pulses, as shown schematically in FIG. 9. However, because the sweepout field removes ions and electrons, in order to achieve the desired sustaining effect of the sustaining pulses, as described above, an appropriate increase in one or more of the parameters of the sustaining pulses must be made.

Figure 10:
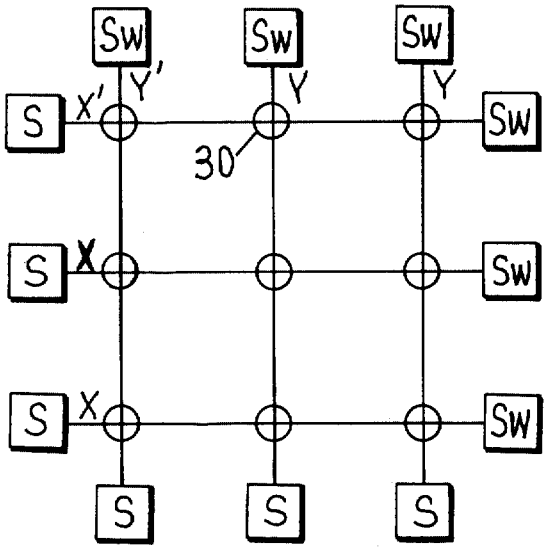
FIG. 10 is a schematic representation of a panel and a circuit for writing information into the panel by means of sweepout pulses.

Sweepout signals may be used not only for minimizing the sensitivity of OFF cells to spurious turn on, but they may be used in conjuction with sustaining signals to write information into a panel, as follows. Referring to FIG. 10, in this method of writing information, sustaining pulses S and sweepout pulses Sw are applied to all X lines and all Y lines, with the proper time spacing between them and with the required signal isolation provided. In this operating routine, the sustaining pulses are set at about the maximum amplitude, duration and repetition rate permissible without having cells spontaneously turn on, and without having the writing operation, to be described, turn on non-selected cells. Then to write or turn on a cell 30', the sweepout signals are removed from the X' and Y' lines which intersect at cell 30' and the sustaining pulses now applied across cell 30' have such character as to cause cell 30' to turn on. The other cells intersected by the X' and Y' lines separately receive a signal routine which includes the full value of sustaining pulses but only half of the full value of the sweepout pulses, since sweepout pulses are present on only one of the lines associated with these other cells. This signal routine is of such character that these other cells intersected by the X' and Y' lines cannot turn on. Finally, after writing is completed, or the write period is terminated, the sustaining pulses are restored to such character that they, alone or in conjunction with sweepout pulses, can sustain glow at the desired level and power consumption in the cells just turned on.

As set forth above under the heading WRITE AND SUSTAIN OPERATIONS, and as illustrated in FIG. 4, a display panel can be operated by a signal routine which includes applying sustaining pulses and then applying write pulses to turn on a particular cell(s). In this type of routine, the write pulses should be applied as close to the end of a sustaining pulse as possible, and, where sweepout pulses are used, as far from the next sweepout and sustaining pulse as possible. Now that the sweepout mechanism has been explained, the reason for this preferred spacing of the write pulses becomes clear. Since the combination of sustaining pulse and sweepout pulse is adjusted to provide the desired sustaining operation, if the write pulses are applied too close to the start of a sustaining pulse, the half-write pulses on the non-selected cells might have the effect of a large sweepout pulse and might cause cells which are ON to turn off.

Sweepout signals can also be used in conjunction with sustaining pulses to erase information from a panel, that is, to turn ON cell(s) off. Referring again to FIG. 10, sustaining pulses are applied to all X lines and Y lines to sustain ON a cell(s) which has been turned on, and they are adjusted to be near the minimum amplitude or time duration or repetition rate necessary to sustain the ON state. To erase a cell(s), sweepout signals Sw are applied to the selected X′ and Y′ lines which intersect at the cell(s) to be erased. If the signal routine already includes sweepout pulses, then the amplitude or time duration of the sweepout signals on the selected X′ and Y′ lines is increased, or the sweepout pulses are shifted closer to the beginning of the associated sustaining pulses which follow them in time. As above, the other cells on the X′ and Y′ line, which may be ON and are not to be erased, receive only half of the applied erase sweepout signals so that, assuming that the sustaining pulses are of the proper character, these unselected cells are maintained ON during this erase operation.

According to still another method of erasing ON cells, alternate sustaining pulses are omitted on selected X′ and Y′ lines, and, after several pulses are omitted, a cell which had been ON will turn off. Other cells on the selected X′ and Y′ lines which had been ON are not affected by this routine since they receive alternately half-value and full-value sustaining pulses.

As a further alternative, the sustaining pulses on the X′ lines and those on the Y′ lines may be alternately omitted so that the cells selected to be erased will have only half-value sustaining pulses for a time, while the non-select cells have alternate half-value and full-value sustaining pulses.

Figure 11:
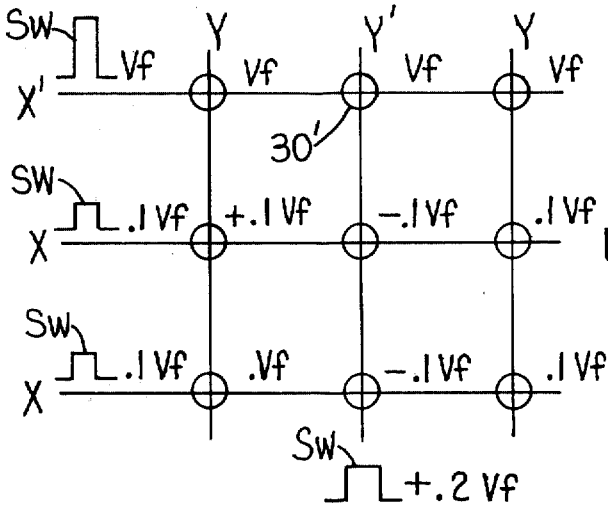
FIG. 11 is a schematic representation of a display panel showing pulses applied to erase fired cells.
Figure 12:
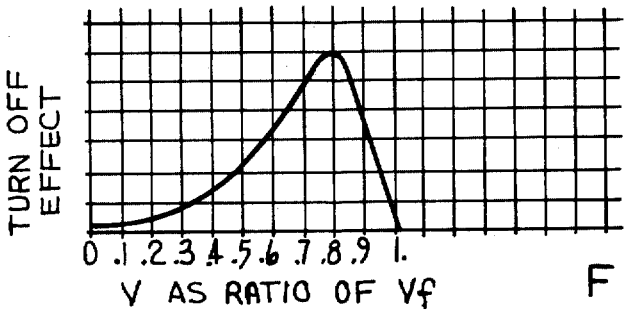
FIG. 12 is a graph of the relationship between the voltages of sweepout pulses the their turn-on and turn-off effect.

Another method of erasing an ON cell(s) is illustrated in FIGS. 11 and 12 and utilizes the fact, illustrated in the curve of FIG. 12, that a sweepout voltage of about 0.8 Vf applied across a cell by means of short duration pulses can act as an erase voltage and can turn an ON cell OFF. In the description of this method, it is assumed that it is desired to turn off cell 30′ which is at the intersection of lines X′ and Y′, and it is further assumed that sustaining pulses are being applied continually to sustain cell 30′ in the ON state as described above. To turn off cell 30′, immediately before a sustaining pulse would normally be applied, a pulse approximately equal to the firing voltage of the cell and of very short duration is applied to the line X′ and a pulse of the same polarity but of approximately 20% of the amplitude of the first pulse is applied to line Y′. In addition, pulses of about 0.1 Vf are preferably applied to the other X lins, but this is not essential. The net voltage which appears at cell 30′ is about 0.8 Vf, and this acts as a strong sweepout and turns off cell 30′. The net voltages appearing across all other cells are shown in FIG. 11, and these cells which carry Vf or 0.1 Vf, or even 0.2 Vf, are not significantly disturbed.

SUMMARY OF TYPICAL OPERATIONS

Figure 13:
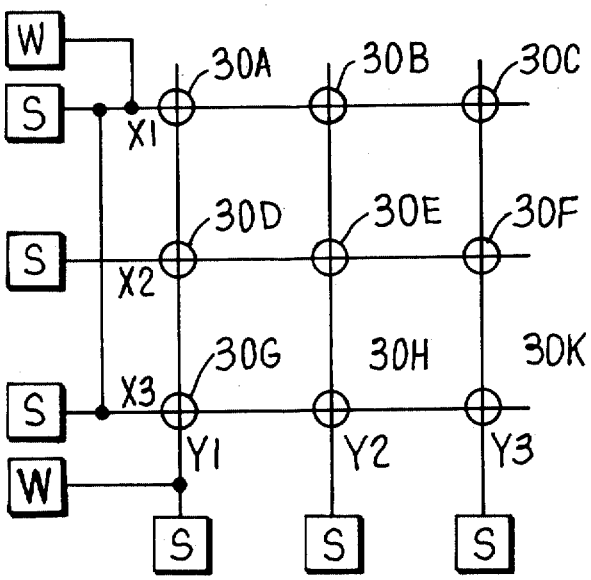
FIG. 13 is a schematic representation of a display panel and a circuit for operating specific signal routines.

Having in mind the various factors and functions already described, it may be well to consider a typical cycle of operation of the described panel. Referring to FIG. 13 and assuming that binary logic information "101" is to be written into and displayed in the lefthand Y column of gas cells 30A, 30D, 30G, by rendering the respective cells from top to bottom ON-OFF-ON, the following methods of operation may be employed.

METHOD I

Sustaining pulses of the proper polarity are applied to all of the X lines and all of the Y lines, and then write pulses W are applied to lines X1, X3, and Y1, preferably close to the end of a sustaining pulse as described above. This causes cells 30A and 30G to fire and provide visible glow, and this glow is sustained by the continuing sustaining pulses. If desired, the sustaining pulses need be applied only to lines X1, X3, and Y1.

Sweepout fields may be used in connection with this method, or in connection with any of the following methods. As already discussed, these fields may be produced by a D.C. voltage applied to all of the cells, or only to the selected cells, but are preferably produced by pulses applied to all or selected ones of the cells just prior to the start of each sustaining pulse.

METHOD II

In this method of operation, write pulses are first applied to lines X1, X3, and Y1 to turn on cells 30A and 30G, and then sustaining pulses S are applied either to lines X1, X3, and Y1, or to all of the lines.

METHOD III

In this method, sustaining pulses are applied either to lines X1, X3, and Y1, or to all of the lines, and then either:

1. the repetition rate of the sustaining pulses is increased on lines X1, X3, and Y1 until cells 30A and 30G turn on, and then the repetition rate is returned to the normal sustaining rate, or
2. the amplitude of the sustaining pulses is increased on lines X1, X3, and Y1 until cells 30A and 30G turn on, then the amplitude of the sustaining pulses is returned to the normal sustaining level, or
3. the time duration of the sustaining pulses on lines X1, X3, and Y1 is increased until cells 30A and 30G turn on, and and the duration is returned to the normal duration for the sustaining operation.

METHOD IV

A fourth method involves the application of sweepout pulses and sustaining pulses to all of the X and Y lines. The sweepout pulses are preferably timed so that one occurs just prior to the start of each sustaining pulse, and the sustaining pulses preferably have an amplitude, duration and repetition rate just below that which would cause any of the cells to be turned ON spontaneously. To write, the sweepout pulses are selectively removed from lines X1, X3 and Y1. Thereafter, the sustaining pulses may be reset to their normal level and the sweepout pulses either dropped or retained.

This method could employ a D.C. sweepout voltage, rather than sweepout pulses, with the voltage being discontinued or offset by an oppositely directed voltage, on the selected lines X1, X3 and Y1. However, the use of sweepout pulses is preferred.

METHOD OF ERASE

Any of the erase techniques already discussed may be used in connection with the writing and sustaining techniques of Methods I to IV. For example, the stored display of binary number 101, in the lefthand column of the panel in FIG. 13, can be erased by (1) temporarily omitting the sustaining pulses from all of the X and Y lines or from all of the X or Y lines alone, which erases the entire panel, or (2) temporarily omitting alternate sustaining pulses from lines X1, X3 and Y1, or (3) temporarily omitting sustaining pulses from the relevant X lines (X1 and X3) and line Y1, alternately, (4) temporarily changing the character of the sustaining pulses, on a panel-wide basis or selective basis, in any way which would render these pulses insufficient to sustain the glowing cells, i.e., by reducing the amplitude or duration or repetition rate of these pulses, or some combination of these parameters.

Also, erase can be accomplished by (5) the application of sweepout signals on an overall or selective basis, preferably in the form of pulses applied just prior to the successive sustaining pulses, or (6) where the applied pulse pattern already includes a sweepout signal, by an overall or selective increase in the sweepout signal, or a shift of the sweepout pulses closer to the beginning of the sustaining pulses which follow them in time, or (7) the application of sweepout voltages in keeping with the curve of FIG. 12, as already discussed.

What is claimed is:

1. An information display system including a glow discharge device comprising an envelope containing a gaseous atmosphere at a pressure capable of sustaining a glow discharge;

at least one anode electrode and one cathode electrode in operative relation with the gas disposed in said envelope, the combination of said gas and said anode electrode and cathode electrode having a characteristic firing voltage;

means for applying a write voltage between said electrodes to produce a glow discharge in the gas between said electrodes, said write voltage having an amplitude greater than that of said characteristic firing voltage and permissibly as much as about twice the amplitude of said firing voltage, said glow discharge generating excited particles in said gaseous atmosphere; and means for applying short duration sustaining pulses between said electrodes starting after the termination of said write voltage and continuing at spaced intervals thereafter but while excited particles still present;

said sustaining pulses being of shorter duration than said write voltage but of sufficient duration to sustain said glow discharge while excited particles are still present; said sustaining pulses having an amplitude greater than that of said firing voltage and a duration and repetition rate sufficient to sustain said glow discharge at a favorable level of light output, current flow, and power dissipation but insufficient to cause arcing; the amplitude, duration, and repetition rate of said sustaining pulses being insufficient to produce said glow discharge if said write voltage has not been applied and excited particles are not present.

2. An information display system including a glow discharge device comprising an envelope containing a plurality of cells, each containing a gaseous atmosphere at a pressure capable of sustaining a glow discharge;

a plurality of electrode pairs, each of which is in operative relation with a cell;

each electrode pair comprising an anode electrode and a cathode electrode in physical contact with the gas disposed in its associated cell and capable, when selected and energized, of establishing electric fields in its associated cell;

each cell having a characteristic firing voltage;

first means for applying a write voltage between selected pairs of electrodes to produce a glow discharge in the cells associated therewith, said write voltage having an amplitude greater than that of said characteristic firing voltage and permissibly as much as about twice the amplitude of said firing voltage; said glow discharge generating excited particles in said gaseous atmosphere;

second means for applying a succession of short duration sustaining pulses between said selected pairs of electrodes starting after the termination of said write voltage and continuing at spaced intervals thereafter but while excited particles are still present;

said sustaining pulses being of shorter duration than said write voltage but of sufficient duration to sustain said glow discharge while excited particles are present; said sustaining pulses having an amplitude greater than that of said firing voltage and a repetition rate sufficient to sustain said glow discharge at a favorable level of light output, current flow, and power dissipation but insufficient to cause arcing; the amplitude, duration, and repetition rate of said sustaining pulses being insufficient to produce said glow discharge if said write voltage has not been applied and excited particles have not been generated.

3. The system defined in claim 2 wherein said second means is a voltage source coupled directly to said selected pairs of electrodes without any intervening current-limiting impedance.

4. A system as in claim 2 wherein said cells are formed by holes passing through a thin panel of insulating material, said holes being disposed in a matrix array, and wherein said electrodes are disposed on opposite sides of said panel, the electrodes on one side being connected to a series of row conductors and the electrodes on the opposite side being connected to a series of column conductors substantially perpendicular to the row conductors, whereby the energization of selected row and column conductors serves to actuate the gas cells located at the intersection of said conductors.

5. A system as in claim 4 wherein said anode electrodes in said device are recessed in the region of the gaseous cells to permit unobstructed viewing of the glow discharges in said cells.

6. A system as in claim 2 wherein said gas atmosphere in said device includes a mixture of gases, at least one of which can be placed in metastable states of excitation to produce a Penning effect within said atmosphere.

7. A light-producing information display system including a glow discharge device comprising a plurality of cells, each containing a gaseous atmosphere at a pressure capable of sustaining a glow discharge and generating excited particles and charged particles, a pair of electrodes in operative relation with each cell, each pair of electrodes being in physical contact with the gas in its cell and being positioned for the application of electric fields across its cell, each cell having a characteristic firing voltage, means coupled to said electrodes for applying a write voltage, of greater amplitude than said firing voltage, to selected pairs of said electrodes to produce a glow discharge and to generate excited particles and charged particles in the corresponding selected ones of said cells, circuit means coupled between said pairs of electrodes for applying a low amplitude particle sweepout voltage to remove said charged particles from said cells after the termination of said write voltage, circuit means coupled between at least said selected pairs of electrodes for applying short duration unidirectional sustaining pulses to said selected ones of said electrodes starting after the termination of said write voltage to sustain glow discharge in said selected cells in which excited particles are still present, said sustaining pulses being insufficent in amplitude, duration, and repetition rate to produce a glow discharge in said selected cells if said write voltage has not been applied and excited particles are not present.

8. A display system as in claim 7 wherein said means for applying a sweepout voltage produces a d-c continuous voltage between said anode and cathode electrodes.

9. A display system as in claim 7 wherein said means for applying a sweepout voltage produces voltage pulses between at least selected ones of said anode and cathode electrodes in the time period between the termination of said write voltage and the initiation of the next sustaining pulse.

10. An information display system including a glow discharge device comprising an envelope containing a gaseous atmosphere at a pressure capable of sustaining a glow discharge, at least one anode electrode and one cathode electrode in physical contact with the gas disposed in said envelope, means for applying a write voltage between said electrodes to produce a glow discharge level of ionization in the gas between said electrodes, means for terminating said write voltage, whereupon said ionization begins to decrease from said glow discharge level toward a lower level at which glow discharge cannot be sustained, means for applying short duration sustaining pulses between said electrodes starting after the termination of said write voltage but before the ionization reaches said lower level and continuing at spaced intervals thereafter, said sustaining pulses being capable of raising the ionization from said lower level to said glow discharge level but being insufficient in amplitude, duration and repetition rate to increase said ionization level to an arcing state or to produce said glow discharge level if said write voltage has not been applied.

11. An information display system including a glow discharge device comprising a plurality of electrode pairs, a plurality of cells in said device each containing a gaseous atmosphere at a pressure capable of sustaining a glow discharge and each being in operative relation to one of said electrode pairs, said electrodes being in physical contact with the gas disposed in said cells being capable when energized of establishing electric fields in selected ones of said cells, means for applying a write voltage between selected ones of said electrodes to produce a glow discharge level of ionization in the gas between said electrodes, means for terminating said write voltage, whereupon said ionization begins to decrease from said glow discharge level toward a lower level at which glow discharge cannot be sustained, means for applying short duration sustaining pulses between at least selected ones of said electrodes beginning after the termination of said write voltage but before the ionization reaches said lower level and continuing at spaced intervals thereafter, said sustaining pulses being capable of raising the ionization from said lower level to said glow discharge level but being insufficient in amplitude, duration and repetition rate to increase said ionization level to an arcing state or to produce said glow discharge level if said write voltage has not been applied.

12. The system of claim 11 wherein said second means is connected so as to apply said sustaining pulses directly to said electrodes without intervening current-limiting impedances.

13. The system of claim 11 wherein said first means and said second means are timed so that said write voltage and said sustaining pulses are spaced apart.

14. A glow discharge display device comprising an envelope containing a gaseous atmosphere at a pressure capable of sustaining a glow discharge and generating excited particles, at least two electrodes located in glow discharge relationship with each other in said gaseous atmosphere, the combination of said electrodes and the gas disposed between them forming a D.C. glow discharge cell and having a characteristic firing potential, means for applying a succession of spaced-apart sustaining voltages of the same polarity between said electrodes of an amplitude, duration and repetition rate insufficient to initiate a glow discharge between said electrodes, but sufficient to maintain a glow discharge once one has been initiated and excited particles have been generated and are present, and means for applying a write signal, between said electrodes and across said cell, or sufficient magnitude to initiate a glow discharge within said cell.

15. A device as in claim 14, wherein the means for applying a write signal comprises means for temporarily increasing at least one of said parameters of amplitude, duration and repetition rate of said sustaining voltages.

16. A glow discharge display device comprising an envelope containing a gaseous atmosphere at a pressure capable of sustaining a glow discharge, a plurality of D.C. glow discharge cells, each such cell including a small volume of the gaseous atmosphere within said envelope and at least two electrodes in glow discharge relationship with said small volume, means for applying a succession of spaced-apart sustaining voltages of the same polarity between at least the electrodes associated with selective ones of said cells of an amplitude, duration and repetition rate insufficient to initiate a glow discharge within the selective cells, but sufficient to maintain such a glow discharge once one has been initiated and excited particles are present, and means for applying a write signal to said selective cells of sufficient magnitude to initiate a glow discharge within said selective cells and to generate excited particles therein.

17. A device as in claim 16 wherein the electrodes are in physical contact with the gaseous atmosphere within the cells.

18. A device as in claim 16 wherein the means for applying a write signal includes means for applying a write voltage intermediate successive sustaining voltages.

19. A device as in claim 18 wherein the means for applying a write signal includes means for applying the write voltage immediately following a sustaining voltage.

20. A device as in claim 16 further including means for applying a charged particle sweepout voltage to said electrodes.

21. A device as in claim 16 further including means for applying charged particle sweepout voltage pulses intermediate successive sustaining voltages.

22. A device as in claim 21 wherein the sweepout voltages means is for applying a sweepout voltage pulse immediately preceding each successive sustaining voltage.

23. A device as in claim 16 wherein said cells are formed by holes passing through a thin panel of insulating material, said holes being disposed in a matrix array, and wherein said electrodes are disposed on opposite sides of said panel, the electrodes on one side being connected to a series of row conductors and the electrodes on the opposite side being connected to a series of column conductors substantially perpendicular to the row conductors, whereby the energization of selected row and column conductors serves to actuate the gas cells located at the intersection of said conductors.

24. A glow discharge display device comprising an envelope containing a gaseous atmosphere at a pressure capable of sustaining a glow discharge and generating excited particles and charged particles, a matrix of gas-filled cells disposed in rows and columns, each of said cells including a small volume of the gaseous atmosphere within said envelope and electrodes located in glow discharge relationship with said gaseous volume, a plurality of row conductors connected to a first electrode in each of said cells, each row conductor being connected to the respective first electrodes of a row of said cells, a plurality of column conductors connected to a second electrode in each of said cells, each column conductor being connected to the respective second electrodes of a column of said cells, means for applying a succession of spaced sustaining voltages between said row and column conductors of an amplitude, duration and repetition rate insufficient to initiate a glow discharge in any of said cells, but sufficient to maintain a glow discharge in said cells once one has been initiated and excited particles are present, and means for applying a write signal between selective ones of said cells of sufficient magnitude to initiate a glow discharge within said selective cells.

25. A device as in claim 24, wherein the means for applying a write signal comprises means for applying half-select write signals to selective ones of said rows and column conductors.

26. A device as in claim 25 further including switching means for applying said half-select write signals to said column conductors one after another sequentially, and means for synchronously applying sequential groups of half-select write signals to selective ones of said row conductors.

27. A device as in claim 24 wherein the means for applying half-select sustaining voltages comprises means for applying half-select sustaining voltages to said column conductors and to said row conductors.

28. A device as in claim 24 further including means for applying charged particle sweepout voltages between successive sustaining voltages.

29. A device as in claim 24 wherein said means for applying sustaining voltages is a voltage source connected directly to said row and column conductors without any intervening impedance elements.

30. A glow discharge display device comprising an envelope containing a gaseous atmosphere at a pressure capable of sustaining a glow discharge and generating excited particles and charged particles, a plurality of gas-filled cells each including a small volume of the gaseous atmosphere within said envelope and electrodes located in glow discharge relationship with said gaseous volume, each of said cells having a characteristic firing voltage $v_f$ and exhibiting a charged particle sweepout characteristic curve of cell turn-off effect plotted against the applied sweepout voltage, which has a maximum point at a $v_m$ below the characteristic firing voltage, means for applying a succession of spaced-apart sustaining voltages between the electrodes of at least selected ones of said cells of an amplitude greater than the characteristic firing voltage and with a duration and repetition rate sufficient to maintain a glow discharge in said cells once one has been initiated and excited particles are present but insufficient to initiate a glow discharge therein, means for applying a write voltage signal of a magnitude greater than $v_f$ across selective ones of said cells to initiate a glow discharge and to generate excited particles and charged particles within said selective cells, and erase means to terminate the glow discharge in at least predetermined ones of said selective cells, said erase means including circuit means for applying a voltage pulse of a magnitude $v_m$ to electrodes of said predetermined cells.

31. A glow discharge display device as in claim 30 wherein said erase circuit means is for applying short duration voltage pulses of a magnitude $v_m$ intermediate successive sustaining pulses.

32. A glow discharge display device comprising an envelope containing a gaseous atmosphere at a pressure capable of sustaining a glow discharge, a plurality of gas-filled cells each including a small volume of the gaseous atmosphere within said envelope and electrodes located in glow discharge relationship with said gaseous volume, each of said cells having a characteristic firing voltage $v_f$ and exhibiting a charged particle sweepout characteristic curve of cell turn-off effect plotted against applied sweepout voltage, which has a maximum point at a voltage $v_m$ below the characteristic firing voltage, means for applying a write voltage signal of a magnitude greater than $v_f$ to selective ones of said cells to initiate a glow discharge within said selective cells and to generate charged particles and excited particles therein, means for maintaining the glow discharge in said selective cells with charged particles and excited particles present therein, and erase means to terminate the glow discharge in at least predetermined ones of said selective cells, said erase means including circuit means for applying a voltage of a magnitude $v_p$ at least as great as said characteristic firing voltage $v_f$ to one of the electrodes of each of said predetermined cells and for applying a voltage $v_p - v_m$ to a second electrode of each of said predetermined cells.

33. A glow discharge display device as in claim 32 wherein said sweepout characteristic curve is a response curve to applied short duration sweepout voltage pulses, and wherein said cirucit means is for applying short duration pulses of said magnitudes $v_p$ and $v_p - v_m$ to the respective electrodes of said predetermined cells.

34. A glow discharge device as in claim 33 wherein said means for maintaining the glow discharge comprises means for applying a succession of spaced-apart sustaining voltages to at least the electrodes of said selected cells of an amplitude, duration and repetition rate insufficient to initiate a glow discharge within the selected cells, but sufficient to maintain a glow discharge therein once one has been initiated.

35. A glow discharge display device comprising an envelope containing a gaseous atmosphere at a pressure capable of sustaining a glow discharge, a matrix of gas-filled cells disposed in rows and columns, each of said cells including small volume of the gaseous atmosphere within said envelope and electrodes located in glow discharge relationship with said gaseous volume, each of said cells having a characteristic firing voltage $v_f$ and exhibiting a charged particle sweepout characteristic curve of cell turn-off effect plotted against applied sweepout voltage pulses, which has a maximum point at a sweepout voltage $v_m$ below the characteristic firing voltage $v_f$, and lower values on both sides of said maximum point, a plurality of row conductors connected to a first electrode in each of said cells, each row conductor being connected to the first electrodes of a row of said cells, a plurality of column conductors connected to a second electrode in each of said cells, each column conductor being connected to the second electrode of a column of said cells, means for applying a write voltage signal of a magnitude greater than $v_f$ across selective ones of said cells to initiate a glow discharge within said selective cells and to generate charged particles and excited particles therein, means for maintaining the glow discharge in said selective cells with charged particles and excited particles present therein, erase means to terminate the glow discharge in at least predetermined ones of said selective cells, said erase means including circuit means for applying pulses of a magnitude $v_p$ at least as great as said characteristic firing voltage $v_f$ to the column conductors which are connected to electrodes of said predetermined cells and for applying a voltage $v_p - v_m$ to the row conductors which are connected to electrodes of said predetermined cells.

36. A glow discharge display device as in claim 35 further including means for applying low voltage levels of a magnitude below $v_p - v_m$ to at least one of the electrodes of the cells of said matrix other than said predetermined cells.

37. A glow discharge display device comprising an envelope containing a gaseous atmosphere at a pressure capable of sustaining a glow discharge and generating excited particles, at least two electrodes located in glow discharge relationship with each other, the combination of said electrodes and the gas disposed between them forming a glow discharge cell and having a characteristic firing potential, means for applying a succession of spaced-apart sustaining voltages between said electrodes of an amplitude, duration and repetition rate insufficient to initiate a glow discharge between said electrodes but sufficient to maintain a glow discharge once one has been initiated and excited particles including metastable states, electrons and ions have been generated by the discharge and are present in the gas, but there are substantially no charges on the walls of said envelope after glow discharge, and means for applying a write signal, between said electrodes and across said cell, of sufficient magnitude to initiate a glow discharge within said cell and thereby generating said excited particles in said cell.

38. In d.c. gas discharge display apparatus display cathode means, display anode means, said display cathode means and said display anode means defining d.c. gas discharge memory cell means for containing an ionizable gas, said cathode and anode means being internal to said cell means and in contact with said gas, and pulse source means coupled without any discharge current limiting resistors to said cathode and anode means for applying a gas discharge sustaining a pulse train therebetween, the pulses thereof being of such amplitude and duration and the spacing between said pulses being such that an ignited memory cell is reignited and an extinguished memory cell remains extinguished upon application of said pulses.

39. In d.c. gas discharge display apparatus display cathode means, display anode means, said display cathode means and said display anode means defining d.c. gas discharge memory cell means for containing an ionizable gas, said cathode and anode means being internal to said cell means and in contact with said gas, addressing means for extending gas discharge columns to selected memory cells thereby increasing the level of ionization therein, and pulse source means coupled without any discharge current limiting resistors to said cathode and anode means for applying a gas discharge sustaining pulse train therebetween, the pulses thereof being of such amplitude and duration and the spacing between said pulses being such that a selected memory cell is ignited by said sustaining pulses in the presence of said increased level of ionization from said extended column and is reignited upon application of subsequent pulses and extinguished memory calls remain extinguished upon application of said pulses.

40. In the apparatus of claim 39 in which said pulse source means includes means for providing said pulses with amplitudes less than the firing potential of said ionizable gas.

41. In the apparatus of claim 39 in which said pulse source means includes means for providing said pulses with amplitudes at least as great as the firing potential of said ionizable gas.

42. In the apparatus of claim 39 in which said ionizable gas comprises a gas exhibiting the penning effect, for increasing the memory margin of said memory cell means with respect to d.c. sustaining potential operation.

43. In the apparatus of claim 42 in which said ionizable gas comprises a penning mixture.

44. In the apparatus of claim 39 in which said pulse source means includes means for providing said sustaining pulse train, the pulses thereof being of such amplitude and duration and the spacing between said pulses being such that less net sustaining power is required with respect to utilizing a minimum possible d.c. sustaining potential.

* * * * *